US009506732B2

(12) United States Patent
Schultz et al.

(10) Patent No.: US 9,506,732 B2
(45) Date of Patent: Nov. 29, 2016

(54) SHOTGUN SHELL WAD

(71) Applicant: SCHULTZ WATERFOWL, LLC., Tremonton, UT (US)

(72) Inventors: Preston R. Schultz, Thatcher, UT (US); Jeffrey C. Schultz, Thatcher, UT (US)

(73) Assignee: SCHULTZ WATERFOWL, LLC., Tremonton, UT (US)

( * ) Notice: Subject to any disclaimer, the term of this patent is extended or adjusted under 35 U.S.C. 154(b) by 0 days.

(21) Appl. No.: 14/548,073

(22) Filed: Nov. 19, 2014

(65) Prior Publication Data

US 2016/0138898 A1 May 19, 2016

(51) Int. Cl.
*F42B 7/08* (2006.01)

(52) U.S. Cl.
CPC ..... *F42B 7/08* (2013.01)

(58) Field of Classification Search
CPC ..... F42B 7/08; F42B 7/04; F42B 7/043; F42B 7/046
USPC ..... 102/532, 450, 451, 453
See application file for complete search history.

(56) References Cited

U.S. PATENT DOCUMENTS

| | | | | |
|---|---|---|---|---|
| 3,309,994 | A * | 3/1967 | Lage | 102/453 |
| 3,516,360 | A | 6/1970 | Lathrope | |
| 3,727,557 | A * | 4/1973 | Starcevich | 102/451 |
| 4,220,090 | A | 9/1980 | Fackler | |
| 4,627,356 | A | 12/1986 | Buczkowski | |
| 5,644,100 | A * | 7/1997 | Puckett et al. | 102/457 |
| 6,260,484 | B1 | 7/2001 | Billings | |
| 6,367,388 | B1 | 4/2002 | Billings | |
| 8,418,620 | B2 * | 4/2013 | Frank | 102/449 |
| 2010/0126371 | A1 | 5/2010 | Gardner | |
| 2010/0192794 | A1 | 8/2010 | Cross | |
| 2013/0055916 | A1 | 3/2013 | Menefee, III | |
| 2013/0055917 | A1 | 3/2013 | Menefee, III | |
| 2013/0228090 | A1 | 9/2013 | Billings | |
| 2013/0291752 | A1 | 11/2013 | Frank | |

FOREIGN PATENT DOCUMENTS

| | | | |
|---|---|---|---|
| EP | 2088393 | * | 8/2009 |
| WO | WO 2013/033344 | * | 3/2013 |

* cited by examiner

*Primary Examiner* — Stephen M Johnson
(74) *Attorney, Agent, or Firm* — Workman Nydegger

(57) ABSTRACT

A shotgun shell wad may include a plurality of resilient flaps spaced evenly around a circumference of a cylindrical body configured to receive shot, with the flaps covering less than half of the circumference. The flaps may be in an undeployed state until a shotgun shell is fired and the wad exits the barrel. The movement of the wad through air may urge the flaps into a deployed state. The flaps may retard the motion of the wad gradually such that the shot and wad remain together for up to 20 meters before decoupling.

20 Claims, 10 Drawing Sheets

SHOTGUN SHELL WAD

CROSS-REFERENCE TO RELATED APPLICATIONS

N/A

BACKGROUND OF THE DISCLOSURE

Firearms use rapidly expanding gasses, typically from an explosive charge, such as smokeless powder, to accelerate a projectile down a barrel of the firearm toward a target. In contrast to bullets used in many rifles and handguns, shotgun shells include a collection of "shot" in the shell. The shotgun uses an explosive charge to accelerate a shot toward a target. Shot can take various forms, including various sizes, quantities, packing orientations, shapes (e.g., spherical, cubic, tetrahedron, etc.), and compositions. The shot may be initially contained by a wad during acceleration of the shot in the barrel. The wad exits the barrel of the shotgun with the shot while the shell remains in the shotgun. Conventional wads may travel a short distance with the shot, but are designed to experience atmospheric drag such that the shot separates from the wad in flight.

Shotguns utilize shot instead of a bullet to allow the shot to spread over an area as the shot travels from the barrel to the target. A bullet is intended to remain a single object during flight of the projectile to the target. The spread of the shot at the target may depend, at least partially, upon a number of characteristics of the shotgun and the shell fired, such as the muzzle velocity of the shot, the length of the barrel, the type of shot, and the distance to the target. The shape and dimensions of the area over which the shot spreads during the flight of the shot is known as the "pattern" of the shot. The pattern may be important to a shooter, as different patterns may be desirable for different purposes and different types of shot.

The shotgun itself may be altered or customized to modify the pattern of the shot. For example, the barrel may be shortened and/or widened (e.g., a home defense shotgun) to decrease the density of the shot pattern (i.e., create a larger spread to the pattern) at the expense of effective range and velocity of the shot. In contrast, a barrel may lengthened and/or constrained (e.g., a choke may be added) to increase the velocity of the shot and to increase the density of the shot pattern (i.e., reduce the area over which the shot spreads).

The wad may also affect the pattern. The wad will exit with the shot after moving through the barrel. The wad is lighter than the shot and will decelerate from drag with the air more readily than the shot, causing the shot and wad to decouple during flight to the target. Rotation of the wad during decoupling may cause the pattern to deviate in the direction of the rotation. Conventional wads are designed to decouple quickly from the shot to minimize the impact unintended rotation may have on the direction and, hence, pattern of the shot. However, after the shot is released from the wad, the shot may experience additional turbulence and drag in the air, causing the shot to slow and spread, reducing the effectiveness of the shot at distance.

BRIEF SUMMARY OF THE DISCLOSURE

This summary is provided to introduce a selection of concepts that are further described below in the detailed description. This summary is not intended to identify specific features of the claimed subject matter, nor is it intended to be used as an aid in limiting the scope of the claimed subject matter.

In a first non-limiting embodiment, a shotgun shell wad includes a cylindrical body having a front end and rear end. The wad has a forward chamber with an opening at the front end and the forward chamber is configured to receive shot. The wad also has a rearward chamber with an opening at the rear end and the rearward chamber is configured to receive a charge. A partition is located in the body between the forward chamber and the rearward chamber and configured to separate the forward chamber and rearward chamber. The body has a plurality of flaps connected at a rearward edge of the flaps and the plurality of flaps have a deployed state and an undeployed state. A combined width of the plurality of flaps constitutes less than half of a circumference of the cylindrical body.

In a second non-limiting embodiment, a shotgun shell wad includes a cylindrical body having a length, a front end, and rear end. The body is continuous about a first full circumference adjacent the front end and a second full circumference adjacent the rear end. The body has a wall thickness along the length of the body. The wad has a forward chamber with an opening at the front end and the forward chamber is configured to receive shot. The wad also has a rearward chamber with an opening at the rear end and the rearward chamber is configured to receive a charge. A partition is located in the body between the forward chamber and the rearward chamber and configured to separate the forward chamber and rearward chamber. The wall thickness proximate the partition is greater than or equal to the wall thickness proximate the front end. The body has a plurality of flaps connected at a rearward edge of the flaps and the plurality of flaps have a deployed state and an undeployed state. A combined width of the plurality of flaps constitutes less than half of a circumference of the cylindrical body and at least two of the flaps substantially opposed one another.

In a third non-limiting embodiment, a shotgun shell wad includes a cylindrical body having a length, a front end, and rear end. The body is continuous about a first full circumference adjacent the front end and a second full circumference adjacent the rear end. The body has a wall thickness along the length of the body and a plurality of flutes spaced evenly about an outer surface of the body extending from the front end rearward. The wad has a forward chamber with an opening at the front end and the forward chamber is configured to receive shot. The wad also has a rearward chamber with an opening at the rear end and the rearward chamber is configured to receive a charge. A partition is located in the body between the forward chamber and the rearward chamber and configured to separate the forward chamber and rearward chamber. The wall thickness proximate the partition is greater than or equal to the wall thickness proximate the front end. The body has a plurality of flaps connected at a rearward edge of the flaps and the plurality of flaps have a deployed state and an undeployed state. A combined width of the plurality of flaps constitutes less than half of a circumference of the cylindrical body.

In a fourth non-limiting embodiment, a shotgun shell includes a cylindrical case, a wad configured to fit inside the case, shot located in the wad, a charge located in the wad, a primer adjacent the charge, and a base that fits around the case at a rearward end of the case. The wad includes a cylindrical body having a front end and rear end. The wad has a forward chamber with an opening at the front end and the forward chamber is configured to receive shot. The wad also has a rearward chamber with an opening at the rear end and the rearward chamber is configured to receive a charge. A partition is located in the body between the forward chamber and the rearward chamber and configured to separate the forward chamber and rearward chamber. The body has a plurality of flaps connected at a rearward edge of the flaps and the plurality of flaps have a deployed state and an undeployed state. A combined width of the plurality of flaps constitutes less than half of a circumference of the cylindrical body.

Additional features of embodiments of the disclosure will be set forth in the description which follows. The features of such embodiments may be realized by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which.

DETAILED DESCRIPTION

One or more specific embodiments of the present disclosure will be described below. In an effort to provide a concise description of these embodiments, some features of an actual embodiment may be described in the specification. It should be appreciated that in the development of any such actual embodiment, as in any engineering or design project, numerous embodiment-specific decisions will be made to achieve the developers' specific goals, such as compliance with system-related and business-related constraints, which may vary from one embodiment to another. It should further be appreciated that such a development effort might be complex and time consuming, but would nevertheless be a routine undertaking of design, fabrication, and manufacture for those of ordinary skill having the benefit of this disclosure.

A shotgun shell wad, in some embodiments, may include a plurality of flaps configured to deploy and retard the motion of the wad after exiting a shotgun. The flaps may be in an undeployed state initially and deploy laterally after firing of the shell. The flaps may be biased to the undeployed position such that the flaps remain in an undeployed position unless a force is applied to expand the flaps laterally outward. A thickness of the flaps, as well as the body of the wad, may be tapered. Alternatively, the flaps and body of the wad may be of substantially uniform thickness over at least a portion of the flaps and/or body.

A flap having a tapered thickness may flex progressively. The wad may contain shot within the wad and the shot may move with the wad for at least part of the time en route to the target. The wad may decouple from the shot over the course of a flight of the shot to the target. The longer the wad stays with the shot, the denser the pattern may be at the point of impact. A wad according to the present disclosure may decouple from the shot at or after 20 meters of flight allowing for improved muzzle velocity, velocity at the target, pattern density, accuracy, or combinations thereof.

Figure 1:
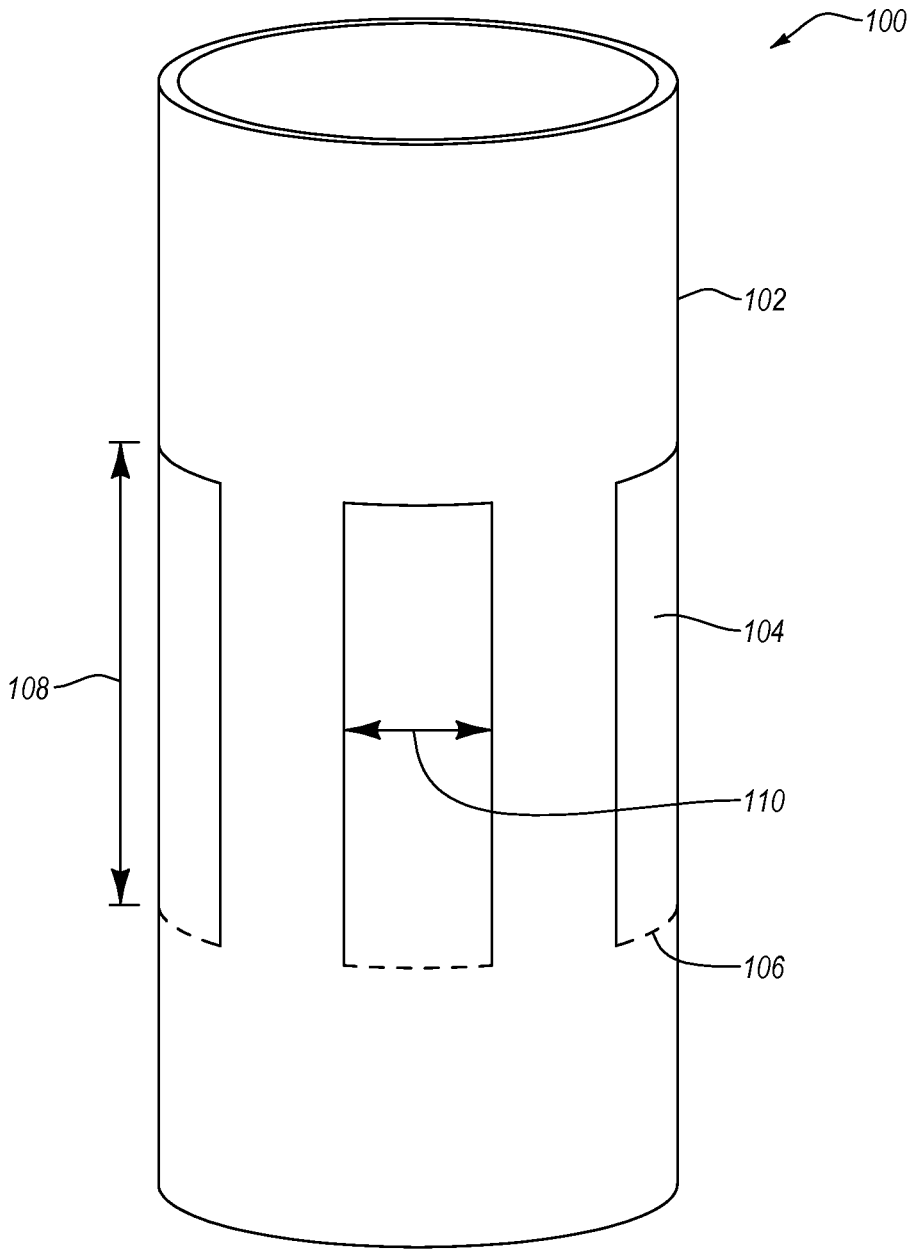
FIG. 1 is a perspective view of an embodiment of a shotgun shell wad having flaps according to the present disclosure.

FIG. 1 depicts an embodiment of a shotgun shell wad 100 according to the present disclosure. The wad 100 may have a substantially cylindrical body 102 that includes a plurality of flaps 104 cut therein. The flaps 104 may be free of any connection to the body 102 on substantially three of four sides. For example, FIG. 1 depicts rectangular flaps 104 that are free on two lateral edges and a forward edge, while being connected to body 102 at movable connection 106 at or along a rearward edge. In other embodiments, the flaps 104 may have a movable connection 106 at a forward edge or a lateral edge and the rearward edge may not be connected. In other embodiments, the flaps 104 may include curved or irregular edges.

As illustrated in FIG. 1, the flaps 104 may have a length 108 and a width 110. In will be appreciated that while the flaps 104 are depicted as being rectangular, in other embodiments, various shapes and configurations may perform the functions thereof. The length 108 and width 110 may vary from an outer surface of the body 102 as compared to an inner surface of the body 102. The length 108 and width 110 of the flaps 104, as well as the shape of the flaps 104, may affect the rate and amount the flaps 104 flex or extend to a deployed position after exiting the barrel.

In some embodiments, the length 108 of the flaps 104 may be within a range having upper and lower values including any of 25%, 30%, 35%, 40%, 45%, 50%, 55%, 60%, and 65% of a length of the body 102, or any value therebetween. For example, the length 108 of the flaps 104 may be between 35% and 65% of a length of the body 102. In at least one embodiment, the length 108 of the flaps 104 may be between 40% and 60% of a length of the body 102. The width 110 of the flaps 104, when combined, may account for a percentage of a circumference of the body 102 in a range having upper and lower values including any of 20%, 25%, 30%, 35%, 40%, 45%, 50%, and any value therebetween. For example, the width 110 of the flaps 104, when combined, may account for a percentage of a circumference of the body 102 between 25% and 50%. In at least one embodiment, the width 110 of the flaps 104, when combined, may account for a percentage of a circumference of the wad 100 between 30% and 45%. The width 110 of each flap 104 may be a percentage of a circumference of the body 102 in a range having upper and lower values including any of 6%, 8%, 10%, 12%, 14%, 16%, and any value therebetween. For example, the width 110 of each flap 104 may be a percentage of a circumference of the body 102 between 8% and 14%. In at least one embodiment, the width 110 of each flap 104 may be a percentage of a circumference of the body 102 may be between 10% and 12%.

FIG. 1 depicts a shotgun shell wad 100 having four flaps 104 in an undeployed state. In some embodiments, a shotgun shell wad may have more or less flaps 104. For example, a shotgun shell wad 100 may have 2, 3, 4, 5, 6, 7, 8, or more flaps 104. In some embodiments, the shotgun shell wad 100 may have an even number of flaps 104. In other embodiments, the flaps 104 may be configured so that a flap 104 substantially opposed another flap 104. For example, in an embodiment of a shotgun shell wad 100 having four flaps 104, the four flaps 104 may be arranged in two pairs of flaps 104, where each pair of flaps are 180° apart. In a more particular embodiment of a shotgun shell wad 100 having four flaps 104, the four flaps 104 may be arranged in two pairs of flaps 104, where the flaps 104 in each pair of flaps 104 are 180° apart and the two pairs are oriented at 90° from one another. In some embodiments, two or more of the flaps 104 may have equal dimensions (e.g., length 108, width 110, thickness, etc.). In other embodiments, at least one of the plurality of flaps 104 may have at least one dimension that varies from at least one other of the plurality of flaps 104.

Figure 2:
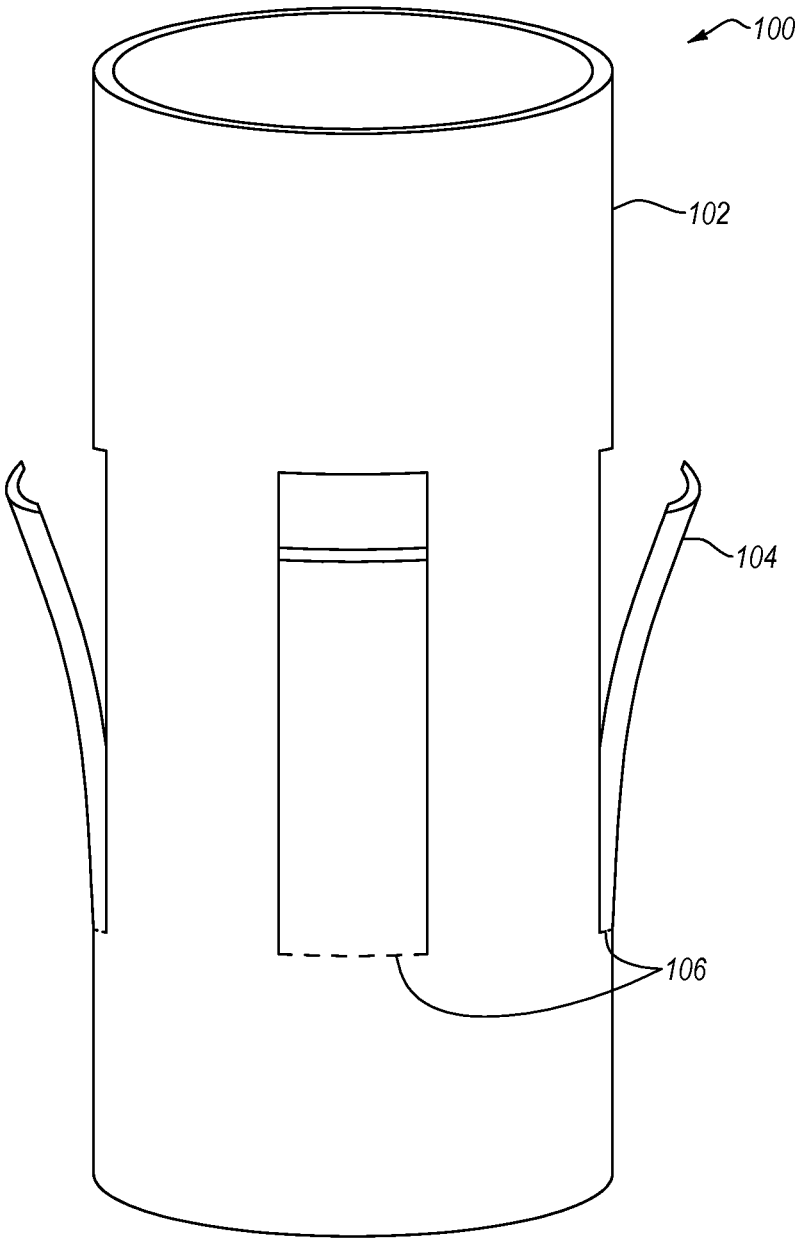
FIG. 2 is a side view of the embodiment of a shotgun shell wad of FIG. 1 wherein the flaps are in a deployed state.

FIG. 2 depicts the shotgun shell wad 100 of FIG. 1 having four flaps 104 in a deployed state. The flaps 104 may deploy radially outward from the body 102. The flaps 104 may expand outward from the movable connection 106 at the rearward edge of the flaps 104 and/or may expand outward through flexion of the flap 104 itself. The flaps 104 may deploy during movement of the shotgun shell wad 100 through the air. One or more flaps 104 in a deployed state may restrict the movement of the shotgun shell wad 100 through the air. A greater deployment (i.e., lateral expansion) of the flaps 104 from the body 102 may provide a greater restriction of the movement of the shotgun shell wad 100.

Figure 3:
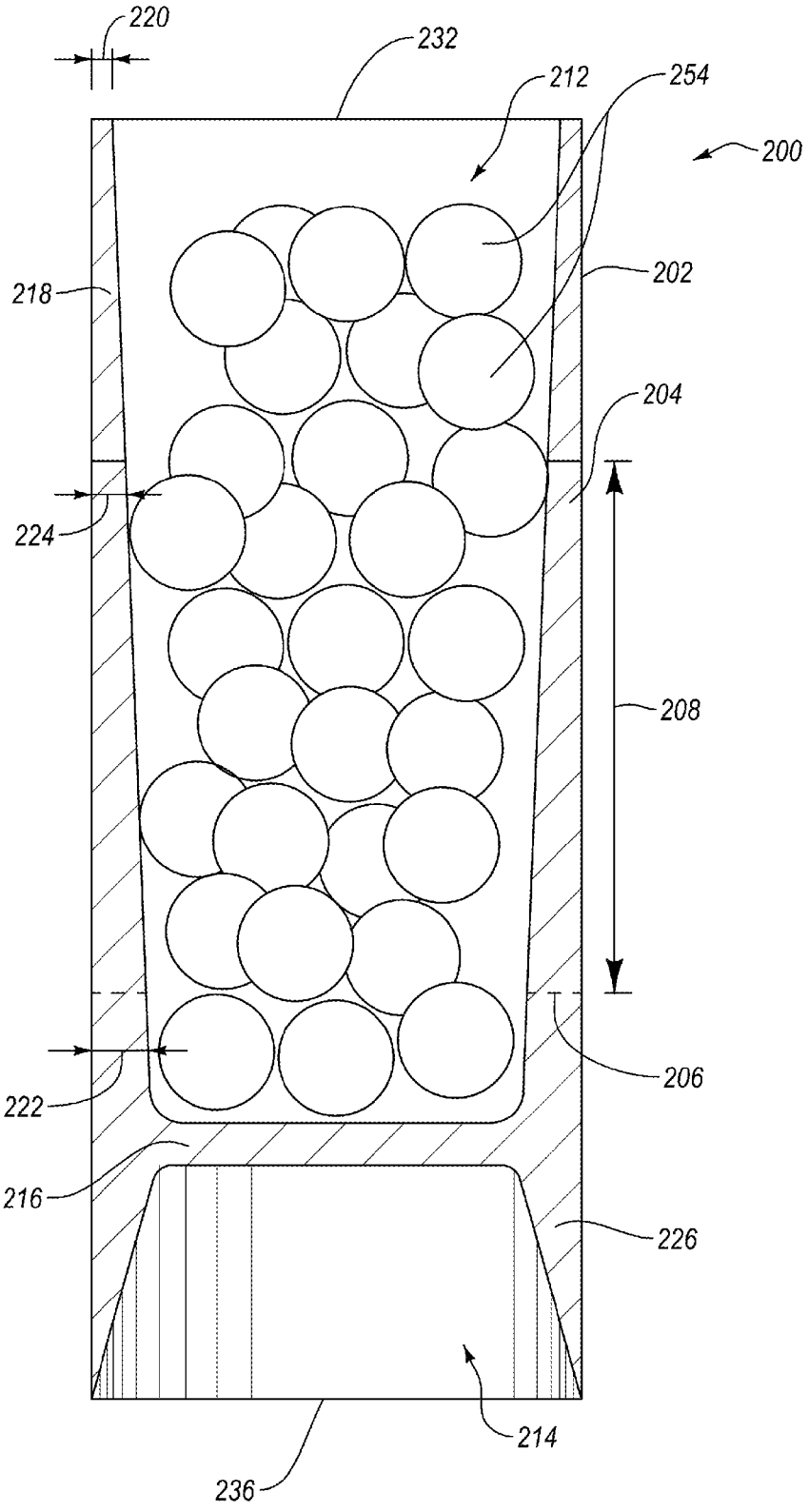
FIG. 3 is a cross-sectional side view of an embodiment of a shotgun shell wad having flaps according to the present disclosure.

FIG. 3 depicts a cross-section of another embodiment of a shotgun shell wad 200 according to the present disclosure. The wad 200 may have a body 202 with a forward chamber 212 and a rearward chamber 214. The forward chamber 212 and the rearward 214 may be separated by a partition 216 that extends substantially laterally across the body 202. As shown in FIG. 3, the body 202 includes the partition 216, forward wall 218, and rearward wall 226 integrally formed together in a continuous piece of material. The partition 216 and the forward wall 218 may define the forward chamber 212. The body 202 may have a substantially constant outer diameter and the forward wall 218 may be tapered. The forward wall 218 may have a first thickness 222 proximate the partition 216 that is greater than a second thickness 220 near a front end 232 of the wad 200. In other embodiments, the forward wall 218 may have a substantially uniform thickness. For example, the first thickness 222 may be approximately the same at the second thickness 220. The plurality of flaps 204 may be positioned in the forward wall 218.

In some embodiments, the plurality of flaps 204 may be positioned such that the body 202 adjacent the front end 232 may be continuous around a full circumference of the body 202. For example, the body 202 adjacent the front end 232 may have no flaps 204 or other cuts, scores, breaks or similar in the body 202 for a length of the forward chamber 212. In other embodiments, the body 202 adjacent the front end 232 may have no flaps 204 or other cuts, scores, breaks or similar in the body 202 for a length of the forward chamber 212 having a range including upper and lower values of 25%, 30%, 35%, 40%, 45%, 50%, 55% or any value therebetween of the full length of the forward chamber 212. For example, the body 202 adjacent the front end 232 may have no flaps 204 or other cuts, scores, breaks or similar in the body 202 for a length of the forward chamber 212 between 30% and 55% of the full length of the forward chamber 212. In another example, the body 202 adjacent the front end 232 may have no flaps 204 or other cuts, scores, breaks or similar in the body 202 for a length of the forward chamber 212 between 35% and 50% of the full length of the forward chamber 212. In yet another example, the body 202 adjacent the front end 232 may have no flaps 204 or other cuts, scores, breaks or similar in the body 202 for a length of the forward chamber 212 equal to approximately 40% of the full length of the forward chamber 212.

In at least one embodiment, the taper in the forward wall 218 may provide a taper in the flaps 204. For example, a first thickness 222 proximate the partition 216 may be greater than a tip thickness 224 of the flap 204. The tip thickness 224 may decrease as a length 208 of the flaps 204 increases. The tip thickness 224 may increase as a length 208 of the flaps 204 decreases.

In at least one embodiment, the taper in the forward wall 218 may contribute to efficient decoupling of the shot 254 and the wad 200. For example, upon acceleration of the wad 200 and associated shot 254 out of a shotgun barrel, the inertia of the comparatively heavy shot may cause the shot 254 to compact into the forward chamber 212 of the wad 200. Furthermore, during flight, air pressure will also contribute to compaction of the shot 254 in the forward chamber 212 of the wad 200. The taper of the forward wall 218 may allow the forward chamber 212 to be wider at the front end 232 than proximate the partition 216. A forward chamber 212 that is wider at the front end 232 may resist the effects of the shot compaction, by having thicker walls near the partition 216 where the force is greatest, and decouple from the shot 254 more easily and with less effect on the pattern, by reducing the effect of any rotation of the wad 200 during decoupling.

Furthermore, the tapered forward wall 218 may allow the flaps 204 to taper in a forward direction. The taper of the flaps 204 may allow the flaps to have a progressive flex as the flaps 204 flex radially outward from the body 202. For example, during movement of the wad 200 through air, the pressure applied to the wad 200 as it displaces the air may force the flaps 204 to expand laterally. The lateral expansion of the flaps 204 may provide drag on the wad 200 to decouple the wad 200 from the shot 254. The flaps 204 may expand laterally more at high velocities than at low velocities. In at least one embodiment, the progressive flex of the tapered flaps 204 may allow the flaps 204 to have less difference in lateral expansion at high velocities and low velocities. The lateral expansion of a tapered flap 204, such as that shown in FIG. 3, may reduce as the flap 204 expands, as the flap 204 may be less flexible closer to the partition 216 where the wall thickness is greater.

The rear chamber 214 may be defined by a rear end 236 and a rearward wall 226. In some embodiments, the rearward wall 226 may have a substantially uniform thickness along at least a portion of the length of the rearward wall 226. The rearward wall 226 may be tapered away from the partition 216 toward the rear end 236. The taper of the rearward wall 226 and/or a profile of the partition 216 (e.g., flat, curved, hemispherical) may provide a rear chamber 214 that is frustro-conical, hemispherical, or a similar shape, such that the rear chamber 214 may receive the force of the rapid expansion of a charge (e.g., charge 1058 shown in FIG. 11) when a shotgun is fired. The taper of the rearward wall 226 may also allow the rearward wall 226 to have a progressive flex and/or expansion. For example, the rearward wall 226 proximate the rear end 236 may stretch and/or expand laterally more than a portion of the rearward wall 226 proximate the partition 216, where the rearward wall 226 is thicker. The progressive flex and/or expansion of the rearward wall 226 may assist in providing a seal against a shotgun shell case (e.g., case 1052 shown in FIG. 11) to efficiently transfer the force of the expansion of the charge to accelerate the wad 200 and shot 254 down the barrel.

In some embodiments, the body 202 adjacent the rear end 236 may be continuous about a full circumference of the body 202. For example, the body 202 adjacent the rear end 236 may have no flaps 204 or other cuts, scores, breaks or similar in the body 202 for a full circumference of the body 202 such that the body 202 may expand radially in a substantially uniform fashion during expansion of a charge and assist in providing a seal against a shotgun shell case.

Figure 4:
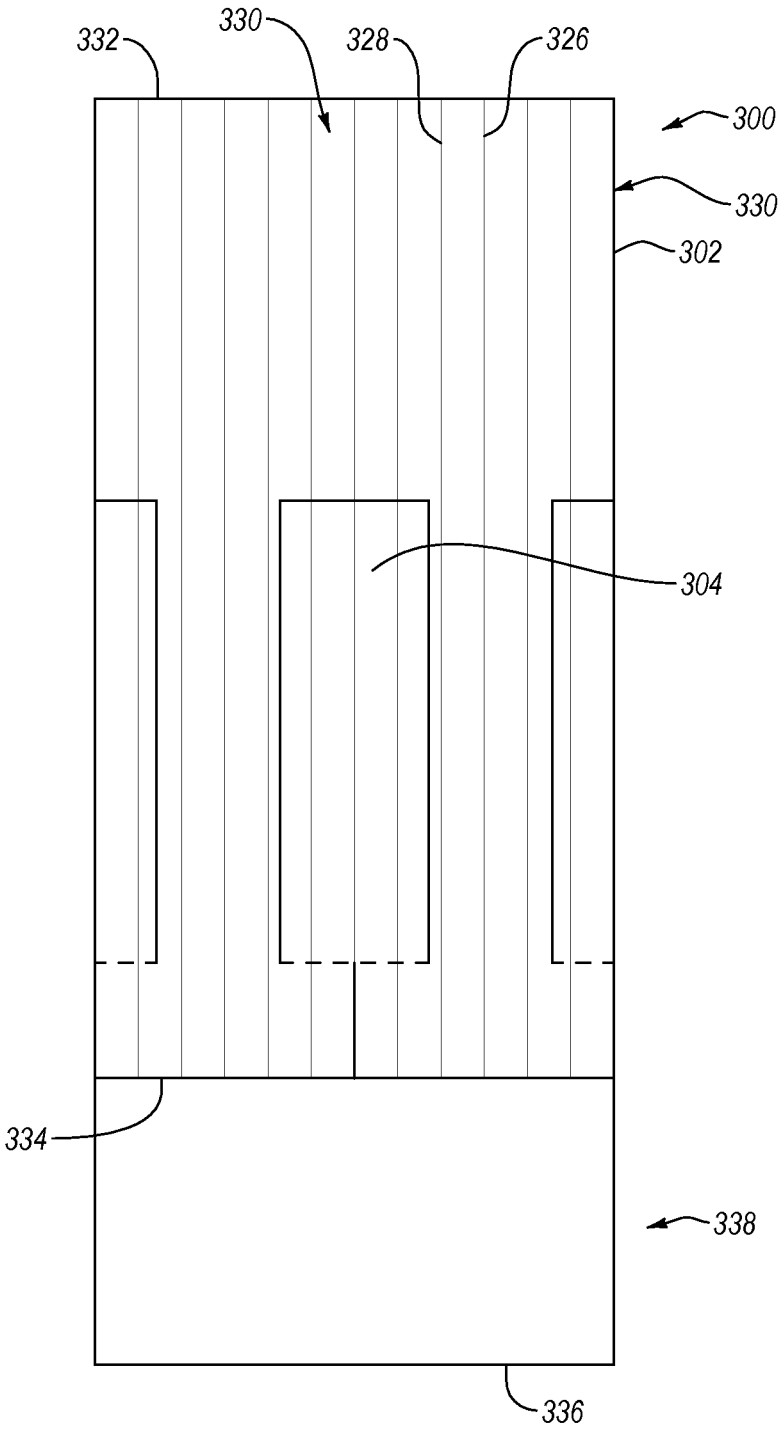
FIG. 4 is a side view of an embodiment of a shotgun shell wad having fluting according to the present disclosure.

FIG. 4 depicts an embodiment of a shotgun shell wad 300 having fluting according to the present embodiment. The wad 300 may have a body 302 with laterally expandable flaps 304 therein. The wad 300 may include a plurality of ridges 326 and recesses 328 in an outer surface 330 of the body. The ridges 326 and recesses 328 may provide fluting in the outer surface 330 that extends from a front end 332 of the body 302 rearward. In some embodiments, the fluting may extend rearward to an intermediate point 334. The intermediate point 334 may be substantially longitudinally aligned with a partition (not shown in FIG. 4) inside the body 302. In other embodiments, the fluting may extend the full length of the body 302.

In at least one embodiment, the ridges 326 and recesses 328 may improve the aerodynamics of the wad both in a barrel and in air. In the barrel, the ridges 326 and recesses 328 may decrease friction with the barrel when compared to a wad having a completely smooth outer surface. Decreased friction may allow the wad 300 and associated shot to exit the barrel with an increased muzzle velocity. In the air, the ridges 326 and recesses 328 may improve aerodynamics by channeling air down the fluting, thereby increasing stability in flight. The ridges 326 and recesses 328 may also create a turbulent delamination layer near the outer surface 330 to minimize effects of the boundary layer, thereby decreasing drag in the air. Both increased stability and/or decreased drag in air may allow the wad 300 and associated shot to maintain its velocity for a longer distance and/or time. Increased stability and/or decreased drag in air may also allow for a shot pattern having increased density.

As shown in FIG. 4, the outer surface 330 of the body 302 may also include a smooth portion 338 proximate a rear end 336 of the body 302. The smooth portion 338 may be devoid of ridges 326 and/or recesses 328 such that the smooth portion 338 may have a substantially constant diameter. Similarly to the expansion of the rearward wall 226 described in relation to FIG. 3, the smooth portion 338 may provide a seal against a shotgun shell case (e.g., case 1052 shown in FIG. 11) to efficiently transfer the force of the expansion of the charge to accelerate the wad 300 down the barrel.

Figure 5:
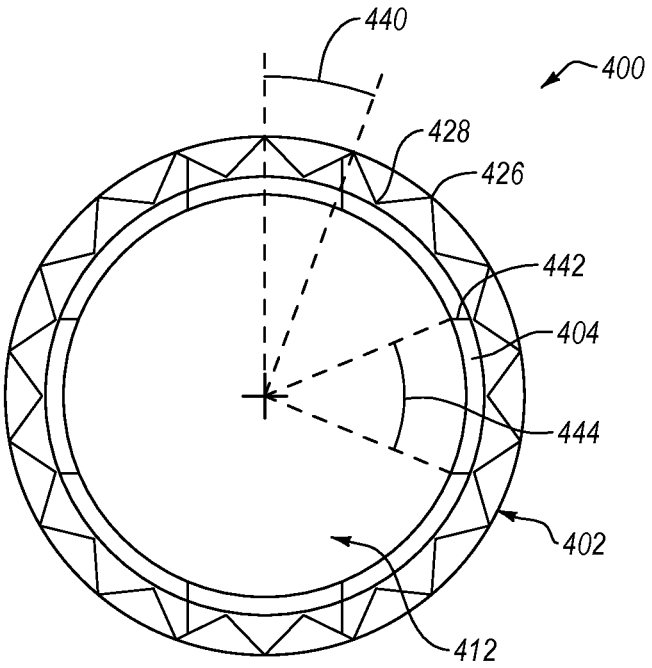
FIG. 5 is a top view of an embodiment of a shotgun shell wad having fluting according to the present disclosure.

FIG. 5 depicts a top view of another embodiment of a shotgun shell wad 400 having fluting according to the present embodiment. In some embodiments, the wad 400 may include a plurality of ridges 426 and recesses 428 spaced evenly circumferentially about a cylindrical body 402. The ridges 426 and recesses 428 may be spaced in a repeating pattern at a fluting interval 440. In some embodiments, the fluting interval 440 may be within a range having upper and lower values including any of 10°, 15°, 20°, 25°, 30°, 35°, 40°, 45°, or any value therebetween. For example, the fluting interval may be between 10° and 35°. In another example, the fluting interval may be between 15° and 30°. In yet another example, the fluting interval may be between 20° and 25°. In at least one embodiment, the fluting interval 440 may be approximately 20°.

The ridges 426 and recesses 428 may be evenly spaced about a circumference of the body 402 or may be unevenly spaced (e.g., a sawtooth pattern). For example, the fluting interval 440 may be 20°, but a ridge 426 may be at each of a 0° position and a 20° position, while a recess 428 may be at an offset, non-central location between the ridges 426, such as at a 15° position.

Also shown in FIG. 5 is a plurality of flaps 404. Each of the flaps 404 may have a cut 442 on either lateral side of the flap 404. The cut 442 may extend through the body 402 and into a forward chamber 412. The cut 442 may be made at any angle relative to the body 402 such that the flap 404 may expand laterally without being impeded by the body 402. For example, FIG. 5 depicts the cuts 442 substantially parallel with a direction of expansion of the flap 404. If the flap 404 were to expand radially, the flap 404 would be pushed outwardly from the body 402 parallel to the direction of the cut 442 on either lateral side of the flap 404.

Each of the flaps 404 may cover a portion of the circumference of the body 402. For example, a flap portion 444 may cover an angular portion of the body 402 within a range having upper and lower values including any of 20°, 25°, 30°, 35°, 40°, 45°, 50°, 55°, 60°, 65°, 70°, 75°, 80°, 85°, 90°, or any value therebetween. For example, a flap portion 444 may cover an angular portion of the body 402 between 20° and 80°. In another example, a flap portion 444 may cover an angular portion of the body 402 between 25° and 60°. In yet another example, a flap portion 444 may cover an angular portion of the body 402 between 30° and 45°. In at least one embodiment, the flap portion 444 may cover approximately 45° of the body 402. In other embodiments, the flap portion 444 may cover approximately 30° of the body 402.

In some embodiments, one or more of the cuts 442 may substantially align with the recesses 428 in the body 402. Alignment with the recesses 428, may allow the cuts 442 to be shorter and cut through a width of the body 402. In other embodiments, one or more of the cuts 442 may not align with the recesses 428, and one or more of the cuts 442 may extend through a larger thickness of the body 402 than another cut 442.

Figure 6:
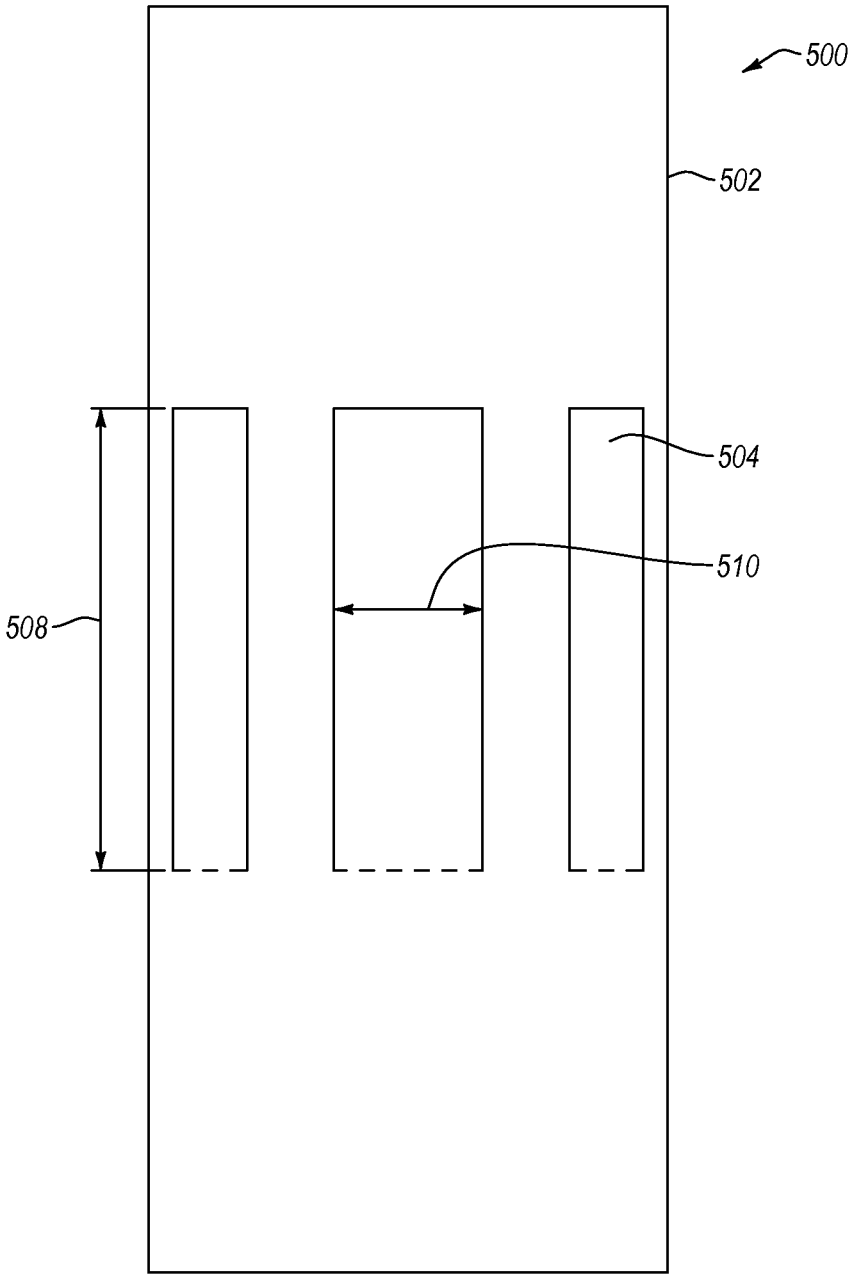
FIG. 6 is a side view of an embodiment of a shotgun shell wad having an increased number of flaps according to the present disclosure.

In contrast to FIG. 5, FIG. 6 depicts an embodiment of a shotgun shell wad 500 that may have more than four (4) flaps 504 spaced even about a body 502. For example, a wad 500 may have six (6) flaps 504 spaced even about a body 502. The flaps 504 may have a width 510 that decreases as the number of flaps 504 increases. The body 502 between the flaps 504 may provide structural integrity to the wad 500 and, therefore, less than 70% of a lateral cross-section through the body may include flaps 504. In some embodiments, a length 508 of the flaps 504 may change during alteration of the number of flaps 504. In other embodiments, a length 508 of the flaps 504 may be constant irrespective of the number of flaps 504.

Figure 7:
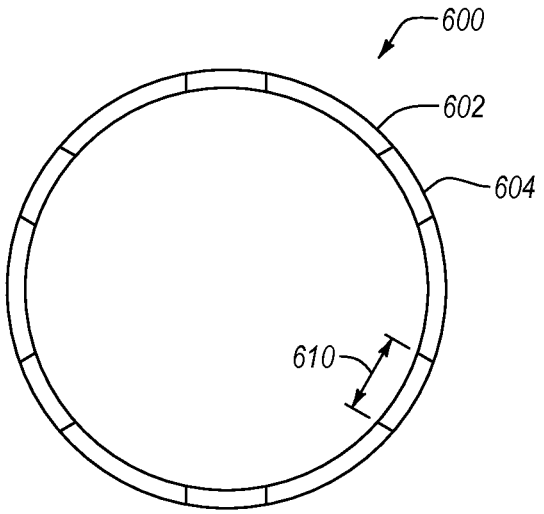
FIG. 7 is a top cross-sectional view of an embodiment of a shotgun shell wad having an increased number of flaps according to the present disclosure.

As shown in FIG. 7, an embodiment of a shotgun shell wad 600 may have a body 602 with flaps 604 formed therein. Flaps 604 having smaller widths 610 and, therefore covering less of the circumference of the body 602, such at those depicted in FIGS. 6 and 7 may expand laterally during movement of the wad 600 more than flaps 604 having greater widths 610. For example, the total air pressure applied to the wad 600 during movement of the wad 600 through air will be about equivalent to a wad having larger flaps, but the area through which the pressurized air may exit in the wad 600 may be less, and therefore, the force on smaller flaps 604 may be increased.

Figure 8:
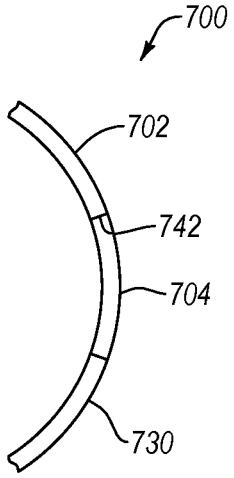
FIG. 8 is a cutaway top view of an embodiment of a shotgun shell wad having flaps cut radially according to the present disclosure.

The movement of a flap from an initial undeployed state laterally outward from the body to a deployed state may be facilitated by inhibiting the movement of the flaps laterally inward. As shown in FIG. 8, a wad 700 may have cuts 742 that separate one or more flaps 704 from a body 702. In some embodiments, the cuts 742 may be oriented perpendicularly with respect to the body 702. For example, the cuts 742 may be perpendicular to an outer surface 730 of the body 702 and/or the cuts 742 may be parallel to a radial direction of the cylindrical body 702. A flap 704 in a wad 700 having radial cuts 742, such as those depicted in FIG. 8, may contact the body 702 when urged laterally inward toward the body 702. The contact with the body 702 may limit or, in some cases, substantially prevent the movement of a flap 704 laterally inward toward the body 702.

Figure 9:
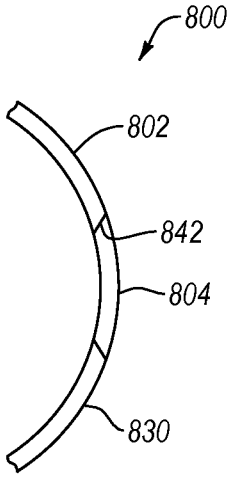
FIG. 9 is a cutaway top view of an embodiment of a shotgun shell wad having flaps cut at an increase angle according to the present disclosure.

FIG. 9 depicts another embodiment of a wad 800 having one or more flaps 804 that may contact a body 802 when urged laterally inward toward the body 802. As shown in FIG. 9, flaps 804 may be separated from the body 802 by cuts 842. The cuts 842 may have a non-perpendicular orientation to the outer surface 830 of the body 802. In some embodiments, the cuts 842 may be oriented at a non-perpendicular angle to the outer surface 830 such that a flap 804 may contact the body 802 when urged laterally inward toward the body 802. The contact with the body 802 may limit or, in some cases, substantially prevent the movement of a flap 804 laterally inward toward the body 802. A flap 804 having cuts 842 that form an angle with the outer surface 830 that is less than 90° may also have a reduce friction when urged radially outward by air pressure within the body 802. The flap 804 may be urge away from the body 802 and may not contact the body 802 as a cut parallel to the direction of motion (e.g., cut 642 in FIG. 7) may during movement of the flap 804.

Figure 10:
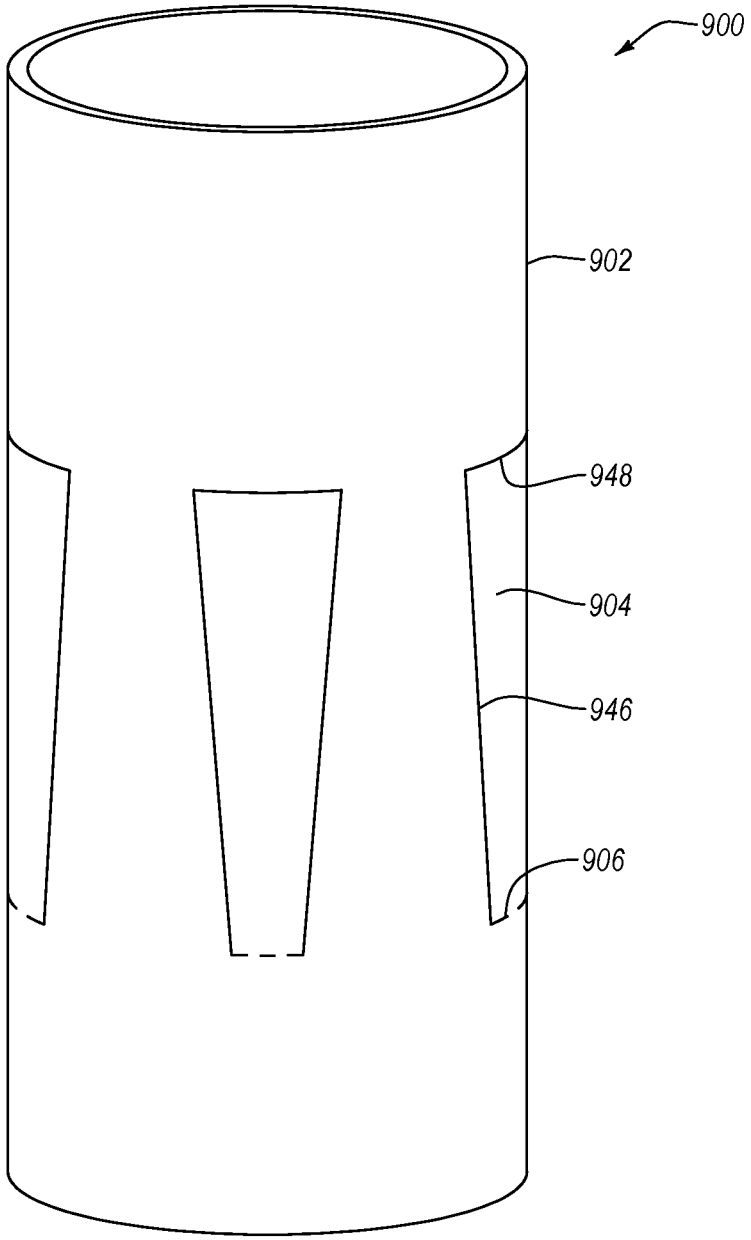
FIG. 10 is a perspective view of an embodiment of a shotgun shell wad having tapered flaps according to the present disclosure.

Referring now to FIG. 10, a wad 900 may have a body 902 with a plurality of flaps 904 therein. At least one of the flaps 904 may have a pair of lateral edges 946 that are angled from a front edge 948 to a movable connection 906 at a rearward end of the flap 904. In some embodiments, the lateral edges 946 may form an angle causing the flap 904 to be tapered from the front edge 948 to the movable connection 906. In other embodiments, the lateral edges 946 may form an angle causing the flap 904 to be tapered in the opposite direction, such as from the movable connection 906 to the front edge 948. In yet other embodiments, the movable connection 906 may be at the front edge 948 of the flap 904 and the flap 904 may be free from any connection with the body 902 rearward of the front edge 948.

As described herein, a flap 904 according to the present disclosure may have a progressive flex. A portion of the flap 904 near the front edge 948 may flex more readily than a portion of the flap 904. A flap 904 having angled lateral edges 946 may allow the amount of movement of the flap 904 to be altered for an applied air pressure during flight. For example, a flap 904 with a smaller movable connection 906 may move (i.e., flex) outwardly more for an applied air pressure than a flap 904 have a larger movable connection 906. In another example, a flap 904 with a larger portion adjacent the front edge 948 may move (i.e., flex) outwardly more for an applied air pressure than a flap 904 have a smaller portion adjacent the front edge 948.

Figure 11:
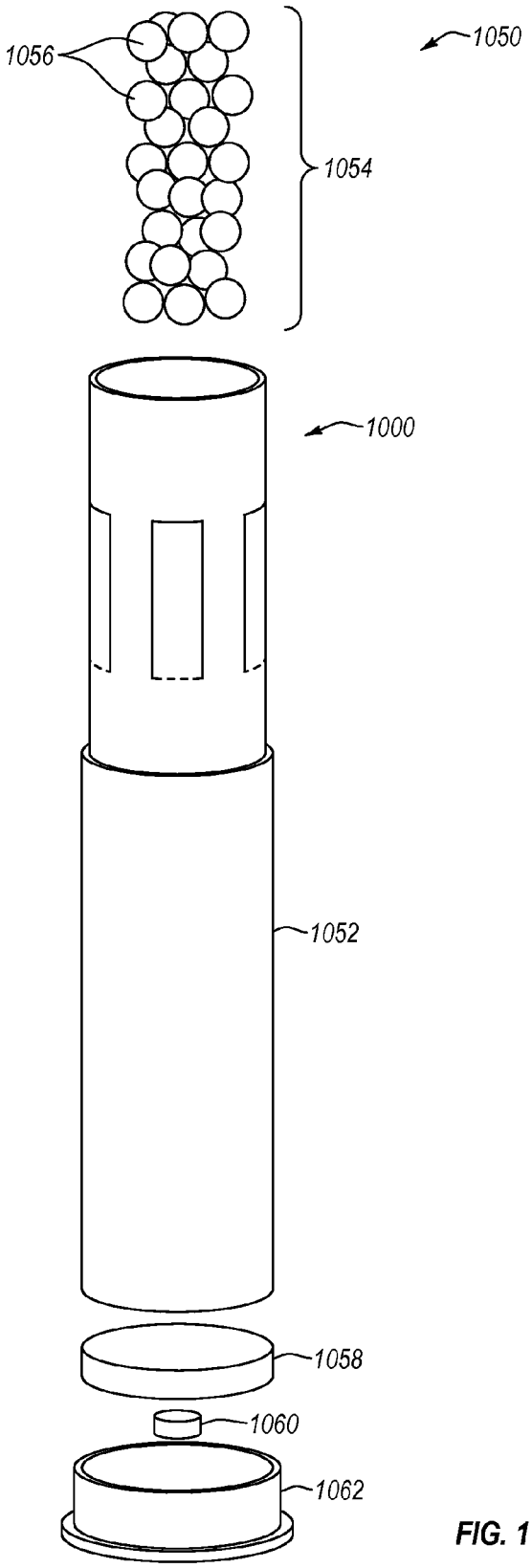
FIG. 11 is an exploded perspective view of an embodiment of a shotgun shell having a shotgun shell wad according to the present disclosure.

FIG. 11 depicts an embodiment of a shotgun shell 1050 comprising a wad 1000 according to the present disclosure. The shell 1050 may include a case 1052 into which the wad 1000 may fit. The case 1052 may be substantially cylindrical. The wad 1000 may, in turn, have shot 1054 contained therein. The individual pellets 1056 of the shot 1054 may be packed into the wad 1000 in any packing scheme appropriate for the size of the pellets 1056 relative to the wad 1000. The shell 1050 may include a charge 1058 configured to fit in the wad 1000 opposite the shot 1054, as described in relation to FIG. 3. The charge 1058 may provide the rapid expansion and energy to accelerate the wad 1000 and associated shot 1054 from the case 1052. The charge 1058 may also apply a force to the wad 1000 that urges at least a portion of the wad 1000 against the case 1052 to provide a seal between the wad 1000 and the case 1052.

The charge 1058 may be adjacent to a primer 1060. The primer 1060 may provide the initial energy to detonate the charge 1058. The primer may be adjacent to, or in some cases extend through, a base 1062. The base 1062 may be configured to fit complimentarily around the case 1052 and retain the charge 1058 and primer 1060 in position adjacent the wad 1000.

In at least one embodiments, a wad 1000 according to the present disclosure may allow the shot 1054 to reach a target with greater velocity than a conventional shotgun shell wad. The increase in velocity may allow the same amount of energy to be delivered to the target with a smaller amount of shot 1054 and a smaller amount of charge 1058. In some embodiments, a smaller amount of shot 1054 and/or charge 1058 may reduce costs, reduce a weight of the shell 1050, increase reliability of the firearm in which the shell 1050 is fired, or combinations thereof. For example, the reduced materials needed for equivalent performance may reduce costs of manufacturing. In another example, the reduced shot 1056 weight and/or charge 1058 weight may allow for a lower overall weight of the shell 1050, and hence allow a user to move more easily or carry more shells. The improved energy delivery with a reduced shot and/or charge 1058 weight may allow the use of smaller shells 1050. Thus, it may allow for a smaller and/or lighter shotgun to be used for an equivalent application (such as waterfowl hunting), further reducing weight for the user. The reduced amount of shot 1054 may also reduce potential wear on a bore of the firearm. The reduced amount of charge 1058 may reduce the frequency with which the shotgun may need cleaning or other maintenance.

In an embodiment, a 2.75 inch 12-gauge shotgun shell 1050 having a wad 1000 according to the present disclosure may deliver a greater amount of energy to a target at 40 yards using a 386 grain (⅞ ounce) shot 1054 and a 41.5 grain (0.086 ounce) charge 1058 than an industry standard 3.50 inch 12-gauge shell with a 601 grain (1⅜ ounce) shot and a 55 grain (0.11 ounce) charge or an industry elite (high-performance) 3.50 inch 12-gauge shell with a 630 grain (1.44 ounce) shot and a 62.6 grain (0.13 ounce) charge. While described in reference to a 2.75 inch shell, it should be understood that a wad 1000 according to the present disclosure may be used in all lengths of shotgun shell including, but not limited to, a 2.75 inch, a 3.00 inch, a 3.50 inch, or other size shell. Similarly, while described in reference to a 12-gauge shell, a wad 1000 according to the present disclosure may be used in all gauges of shotgun shell including, but not limited to, 10, 12, 16, 20, 28, and 0.410 gauges.

Figure 12:
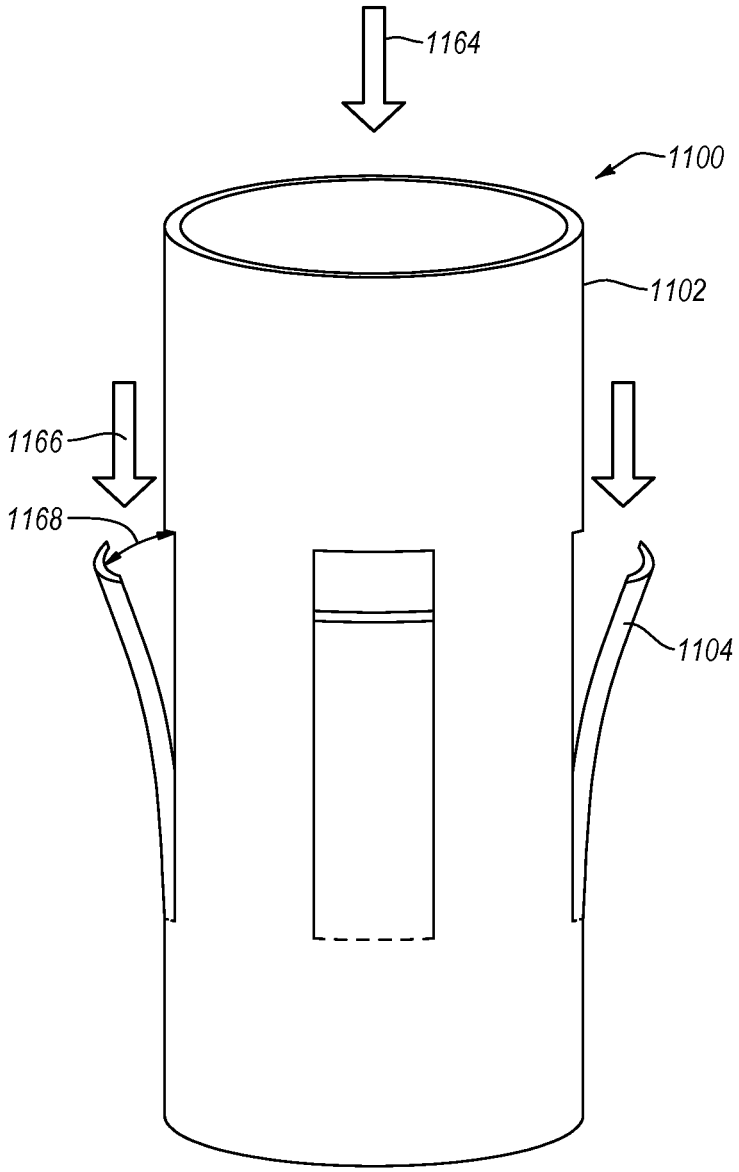
FIG. 12 is a perspective view of an embodiment of a shotgun shell wad having a plurality of flaps in a deployed state according to the present disclosure.

FIG. 12 depicts a wad 1100 having a plurality of flaps 1104 in a deployed state after having been fired from a shotgun shell similar to or the same as described in relation to FIG. 11. The flaps 1104 may initially be in an undeployed state until an interior air pressure 1164 applies a force to the wad to urge the flaps 1104 laterally outward away from the body 1102. After initial deployment, the flaps 1104 may interact with an exterior air pressure 1166. The exterior air pressure 1166 may apply a force to the flaps 1104 in a deployed state to hold the flaps 1104 in a deployed state. The interior and exterior air pressures 1164, 1166 may be proportional to the velocity and orientation of the wad 1100 in the air, therefore, a deployment angle 1168 may be at least partially dependent upon the velocity and orientation of the wad 1100 in the air. A larger deployment angle 1168 may provide a greater drag coefficient of the wad 1100 to retard the movement of the wad 1100 during flight. The greater the drag, the greater the rate of decoupling of the wad 1100 and associated shot (not shown in FIG. 12).

The drag on the wad 1100 may be greatest at highest speed both due to a greater deployment angle 1168 providing a greater drag coefficient and also drag force being proportional to a square of the velocity. For example, as the velocity of the wad 1100 increases, the deployment angle 1168 may increase, resulting in an increased amount of drag force on the wad 1100. However, as the wad 1100 slows, the velocity and the deployment angle 1168 (and, hence, drag coefficient) of the wad 1100 may both decrease, resulting in an exponential decrease in force applied to slow the wad 1100. A gradual decoupling of the wad 1100 and shot may allow a tighter pattern and higher energy of the shot at the target.

The articles "a," "an," and "the" are intended to mean that there are one or more of the elements in the preceding descriptions. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features. Any elements and/or embodiments described herein may be combinable with any other described elements and/or embodiments. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed:

1. A shotgun shell wad comprising:

a cylindrical body having a front end and a rear end, the body being continuous about a first full circumference adjacent the front end and a second full circumference adjacent the rear end;

a forward wall of the body defining a forward chamber located in the body, the forward chamber having an opening at the front end;

a rearward wall of the body defining a rearward chamber located in the body, the rearward chamber having an opening at the rear end;

a partition located in the body between the forward chamber and the rearward chamber, the partition separating the forward chamber and the rearward chamber, the forward wall, rearward wall, and partition being integrally formed together; and a plurality of flaps formed in the forward wall of the body, the plurality of flaps having a forward edge and a rearward edge, the forward edge being at least as wide as the rearward edge, the flaps being connected at the rearward edge to the body and having a deployed state and an undeployed state, wherein a combined width of the plurality of flaps constitutes less than half of a circumference of the body.

2. The shotgun shell wad of claim 1, the cylindrical body including a plurality of ridges on an outer surface thereof.

3. The shotgun shell wad of claim 1, wherein at least one of the plurality of flaps is less than 45 degrees of the circumference of the body when in an undeployed state.

4. The shotgun shell wad of claim 1, wherein at least one of the plurality of flaps has a length that is equal to or less than 65% of the a length of the body.

5. The shotgun shell wad of claim 1, wherein at least one of the plurality of flaps comprise a forward edge, the forward edge being positioned a distance from the front end of the body, the distance being between 25% to 50% of a length of the forward chamber.

6. The shotgun shell wad of claim 1, wherein the wad comprises four flaps, each of the four flaps being circumferentially spaced about the cylindrical body and the flaps each substantially opposing another flap.

7. The shotgun shell wad of claim 1, wherein the partition includes a concave surface toward the rearward chamber.

8. A shotgun shell wad comprising:

a cylindrical body having a length, a front end and a rear end, the body having wall thickness along the length and the body being continuous about a first full circumference adjacent the front end and a second full circumference adjacent the rear end;

a forward wall of the body defining a forward chamber located in the body, the forward chamber having an opening at the front end;

a rearward wall of the body defining a rearward chamber located in the body, the rearward chamber having an opening at the rear end;

a partition located in the body between the forward chamber and the rearward chamber, the partition separating the forward chamber and the rearward chamber, the forward wall, rearward wall, and partition being integrally formed together, wherein the wall thickness of the body being proximate the partition is greater than or equal to the wall thickness of the body proximate the front end; and a plurality of flaps formed in the forward wall of the body, the flaps having a forward edge and a rearward edge, the forward edge being at least as wide as the rearward edge, the flaps connected at the rearward edge and having a deployed state and an undeployed state, wherein the flaps constitute less than half of a circumference of the body and at least two of the plurality of flaps are positioned substantially opposite one another.

9. The shotgun shell wad of claim 8, wherein the wall thickness decreases from proximate the partition to the front end.

10. The shotgun shell wad of claim 8, wherein the wall thickness decreases from proximate the partition to the rear end.

11. The shotgun shell wad of claim 8, wherein the flaps have lateral edges that form an angle such that at least one flap is tapered from the front edge to the rearward edge.

12. The shotgun shell wad of claim 8, wherein the body has a plurality of flutes spaced evenly about an outer surface of the body, the flutes extend from the front end rearward.

13. A shotgun shell wad comprising:

a cylindrical body having a length, a front end and a rear end, the body having wall thickness along the length and the body being continuous about a first full circumference adjacent the front end and a second full circumference adjacent the rear end, the body having a plurality of flutes spaced evenly about an outer surface of the body, the flutes extend from the front end rearward;

a forward wall of the body defining a forward chamber located in the body, the forward chamber having an opening at the front end;

a rearward wall of the body defining a rearward chamber located in the body, the rearward chamber having an opening at the rear end;

a partition located in the body between the forward chamber and the rearward chamber, the partition separating the forward chamber and the rearward chamber, the forward wall, rearward wall, and partition being integrally formed together, the wall thickness of the body being greatest proximate the partition; and at least four flaps formed in the forward wall of the body, the flaps having a forward edge and a rearward edge, the forward edge being at least as wide as the rearward edge, the flaps connected at the rearward edge and having a deployed state and an undeployed state, wherein the flaps constitute less than half of a circumference of the body and the forward edge of the flaps is located rearward of the front end of the body.

14. The shotgun shell wad of claim 13, wherein the plurality of flutes have fluting interval between 10° and 45°.

15. The shotgun shell wad of claim 13, wherein the second full circumference adjacent the rear end of the body has a smooth outer surface and is substantially longitudinally aligned with the rearward chamber.

16. A shotgun shell comprising:

a cylindrical case;

a wad configured to fit inside the case, the wad comprising:

a cylindrical body having a front end and a rear end, the body being continuous about a first full circumference adjacent the front end and a second full circumference adjacent the rear end, a forward wall defining a forward chamber located in the body, the forward chamber having an opening at the front end, a rearward wall defining a rearward chamber located in the body, the rearward chamber having an opening at the rear end, a partition located in the body between the forward chamber and the rearward chamber, the partition separating the forward chamber and the rearward chamber, the forward wall, rearward wall, and partition being integrally formed together, and a plurality of flaps formed in the forward wall of the body, the flaps having a forward edge and a rearward edge, the forward edge being at least as wide as the rearward edge, the flaps connected at the rearward edge and having a deployed state and an undeployed state, wherein the flaps constitute less than half of a circumference of the body;

shot located in the forward chamber of the wad;

a base configured to circumferentially seal around the case;

a charge located in the rearward chamber of the wad and in the base; and a primer located adjacent to the charge on at least one side.

17. The shotgun shell of claim 16, wherein at least part of an outer surface of the body forms a seal with inner surface of the casing.

18. The shotgun shell of claim 16, wherein the forward wall having a wall thickness which tapers from the partition to the front end.

19. The shotgun shell of claim 16, wherein the rearward wall having a wall thickness which tapers from the partition to the rear end.

20. The shotgun shell of claim 16, wherein the body has a plurality of flutes spaced even about an outer surface of the body, the flutes extend from the front end rearward.

* * * * *